United States Patent [19]

Goldfarb et al.

[11] 4,023,524

[45] May 17, 1977

[54] TOY SPRAY PAINTING SYSTEM

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe, both of Northridge, Calif.

[22] Filed: Feb. 12, 1976

[21] Appl. No.: 657,459

[52] U.S. Cl. ..... 118/301; 46/44; 101/126; 118/503; 222/335; 222/372; 239/346; 248/451

[51] Int. Cl.[2] ..... B05B 15/04; A63H 33/30; B05C 17/08; B05B 7/08

[58] Field of Search ..... 239/341, 346, 351, 355, 239/361–363; 222/193, 204, 335, 372, 379, 405; 46/44; 118/301, 406, 503, 504, 213; 248/441 R, 450–454; 35/26; 33/174 B; 101/48, 112, 114, 115, 121, 126, 127

[56] References Cited

UNITED STATES PATENTS

| | | | |
|---|---|---|---|
| 886,979 | 5/1908 | Holt | 222/193 |
| 1,218,685 | 3/1917 | Mollenhauer | 239/341 X |
| 2,035,677 | 3/1936 | Steinke | 118/301 UX |
| 2,550,404 | 4/1951 | Chasan et al. | 239/346 |
| 3,744,412 | 7/1973 | Grue et al. | 118/301 X |

FOREIGN PATENTS OR APPLICATIONS

| | | | |
|---|---|---|---|
| 681,347 | 3/1964 | Canada | 239/346 |
| 201,445 | 11/1938 | Switzerland | 239/362 |

*Primary Examiner*—Johnny D. Cherry
*Assistant Examiner*—Andres Kashnikow
*Attorney, Agent, or Firm*—Robert M. Ashen; Robert J. Schaap

[57] ABSTRACT

A toy spray painting system which includes a hand-held manually powered spray gun along with an easel for holding a substrate such as paper to receive a paint spray from the spray gun. The hand-held spray gun includes a frame having a pistol-grip handle with a trigger for one hand operation. Squeezing of the trigger will operate a member to issue air under pressure; the member could adopt the form of, for example, an expandable and contractable bellows which is operable by squeezing the trigger. Upon squeezing of the trigger, air under pressure is ejected through an orifice in a spray head of the spray gun to create an issued air stream. The issued air stream passes over a paint outlet defined by an opening in the upper end of an upright tube which extends down into a container of liquid paint. The paint container is also held by the frame. The spray gun operates in the manner of a liquid ejector so that a portion of the liquid paint is atomized and entrained in and carried by the stream to the substrate. Due to the design of the spray gun, it can be held and operated in one hand merely by squeezing the trigger. An adjustable mechanism on the spray gun permits adjustment of the height of the paint outlet relative to the height of the orifice in order to adjust the amount of paint entrained in the air stream. Stencils may be provided for face-wise disposition over the paint receiving surface of the substrate to create various patterns.

11 Claims, 9 Drawing Figures

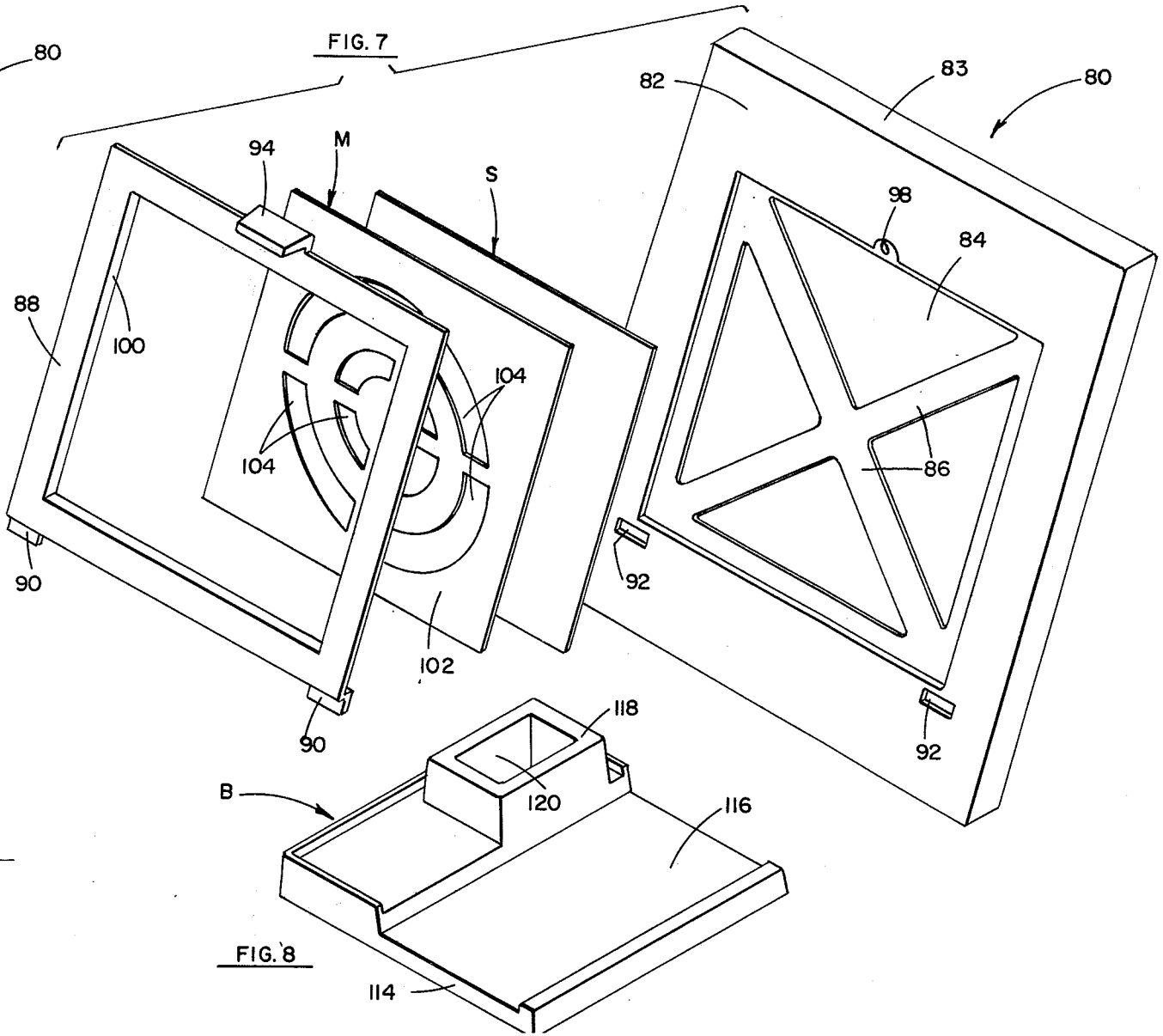
FIG. 7
FIG. 8
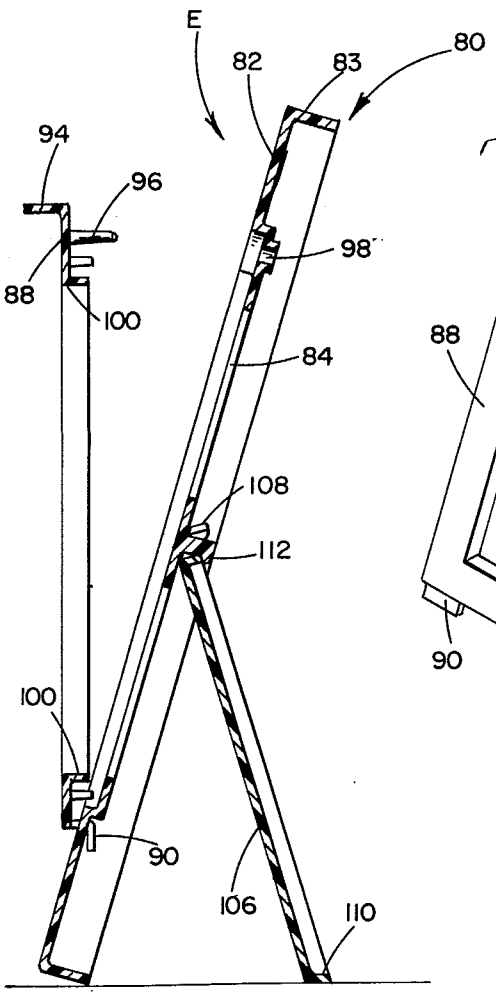
FIG. 6

TOY SPRAY PAINTING SYSTEM

BACKGROUND OF THE INVENTION

This invention relates in general to certain new and useful improvements in toy paint spraying systems and, more particularly, to paint spraying systems which include a manually powered hand-held spray gun which operates on the principle of a liquid ejector.

There have been "artist air brushes" where the user blows through a flexible tube to thereby atomize a spray of paint. The amount of paint sprayed was contolled by the strength of blowing. Such an air brush is unsanitary for use by children who tend to pass toys back and forth between them, and its use could result in the dnagerous inhalation of fumes by the child if he draws in on the tube.

There are a large number of commercially available hand-held paint spray guns which are used in various commercial and industrial operations. Many of these spray guns usually operate in conjunction with a source of compressed air which is normally generated by an air compressor. The air under pressure is passed through a nozzle having an air orifice to create an educted air stream issued from the air ofifice which is designed to entrain and atomize the liquid paint in the air stream. However, due to the substantial cost, the complexity of operation and the potential danger attendant to operation of spray guns operable with a source of air under pressure, these devices are relatively ineffective for use as toy spray painting systems for children.

There have been other forms of paint spray guns which operate on the liquid ejector principle but employ a tank or cannister of compressed gas such as compressed carbon dioxide to create the educted air stream. These latter forms of spray guns were often designed in the form of a so-called "artist's brush". However, the gun was designed to create a carefully controlled spray and was usually quite expensive. In addition, a source of compressed gas was also necessitated. Accordingly, these latter forms of spray guns also suffered from the same deficiencies mentioned above and were therefore ineffective for use as a toy spray gun. In fact, a toy spray gun of this type was produced and offered for sale but it was never successful.

Thus, there are no commercially available effective toy spray painting systems for use by children. The commercially available hand-held spray guns are ineffective for modification into toy spray guns due to the disadvantages mentioned above. Moreover, the commercially available industrial-type spray guns operate at a pressure which is excessive for use in a toy spray gun and which would ultimately result in problems of over-spray, along with the difficulty of confining a paint spray stream within a desired location, and which would thereby result in paint spray damage to the surrounding environment.

It is, therefore, a primary object of the present invention to provide a toy paint spraying system which includes a manually powered hand-held spray gun and operates on the principle of a liquid ejector.

It is another object of the present invention to provide a toy hand-held spray gun which operates on the principle of a liquid ejector and includes relatively few moving parts which thereby eliminates the normal breakdown inherent in children's toys which contain a large number of moving parts.

It is a further object of the present invention to provide a toy spray painting system of the type stated which includes a novel easel construction to enable a child to direct a paint spray through a stencil to a substrate, and thereby generate an aesthetic pattern on a substrate.

It is also an object of the present invention to provide a toy hand-held spray gun of the type stated which operates on the principle of a liquid ejector and includes an adjustment means for regulating the amount of paint entrained in an air stream issued by the spray gun.

It is an additional object of the present invention to provide a toy hand-held spray gun of the type stated which includes a pistol grip handle construction to enable a child to hold and operate the spray gun with one hand.

It is another salient object of the present invention to provide a method of permitting children to generate spray patterns on a substrate by a hand-held toy paint spraying gun.

With the above and other objects in view, our invention resides in the novel features of form, construction, arrangement, and combination of parts presently described and pointed out in the claims.

SUMMARY OF THE DISCLOSURE

The present invention relates in general to a toy spray painting system which includes a hand-held manually powered spray gun which operates on the principle of a liquid ejector. In addition, the present invention provides a unique easel construction which may be utilized with the toy paint sprayig gun.

The paint spraying gun generally comprises an outer housing having a chamber member. This chamber member may adopt the form of a piston-cylinder arrangement, or an expandible and contractible flexible chamber forming member, or the like. The flexible chamber forming member in the preferred embodiment is an expandible and contractible bellows which is capable of emitting air when contracted. The flexible chamber forming member, such as the bellows, is provided with a check valve such that the check valve is closed when the bellows is contracted and opened when the bellows expands. In this way, air contained within the chamber of the bellows will be ejected through an outlet from the bellows, and upon expansion, the check valve will be opened and air from the external atmosphere can again fill the bellows.

The air which exits the bellows is passed through an air orifice to provide a stream of air under pressure. A container of liquid paint is also removably mounted on the housing and includes an upwardly extending tube which communicates with the paint in the container. As the air passes through the air orifice, a portion of the liquid paint will be sucked up through the tube and out the paint outlet at the tube upper end and atomized for entrainment in and carrying in the air stream. In accordance with this construction, no external source of air or other gas under pressure is required.

A pistol-grip handle is also mounted on the housing and pivotally carries a trigger member. This trigger member is connected to the chamber member. Thus, in the case of the bellows, manual squeezing of the trigger member will cause compression of the bellows and which will, in turn, generate an air stream. A release of the trigger member will permit the normal expansion of the bellows as previously described.

The device is provided with an adjustment mechanism in order to permit the relative position of the paint outlet with respect to the air orifice. In this way, it is possible to regulate the amount of paint which is atomized in the air stream and to thereby regulate the blend of air and paint carried in the air stream.

The pistol-grip type handle with the trigger carried thereby enables the spray gun to be held in one hand and operated by the same hand. Thus, mere squeezing of the trigger will operate to produce the required stream under pressure, thereby obviating the need of any external source of gas under pressure. In addition, the spray gun is so designed that it is not necessary to use two hands to operate the same.

The easel construction of the present invention includes a base which is capable of holding an easel frame. The easel frame includes a rectangular plate having a recess therein for receiving a substrate, such as a paper sheet. A stencil is provided for face-wise disposition over the substrate and is marginally sized with respect to the substrate and the recess in the easel frame. A retaining frame is capable of being connected to the easel frame for holding the stencil and the substrate on the easel frame. The stencil is provided with openings to form a pattern. In this way, a child who utilizes the hand-held spray gun may direct a stream of air with the paint entrained therein toward the substrate. The air stream with the paint entrained therein will pass through the openings in the stencil and impinge upon the substrate to create a painted pattern in conformance with the openings in the stencil.

BRIEF DESCRIPTION OF THE DRAWINGS

Figure 1:
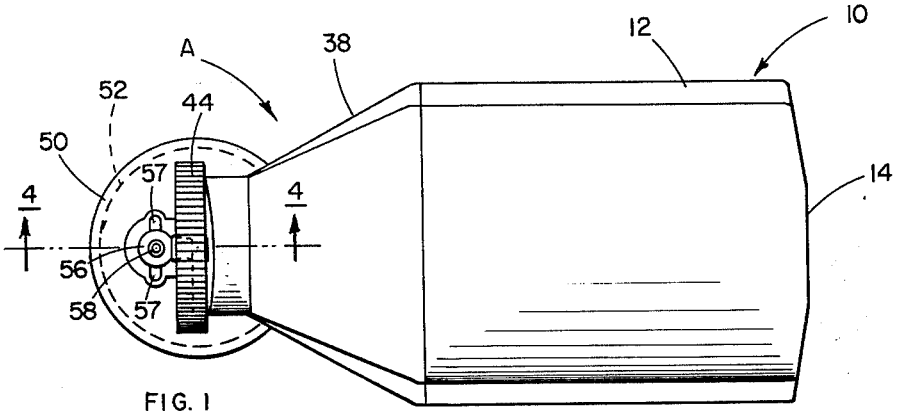
Figure 5:
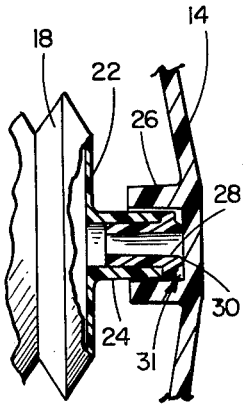
Figure 2:
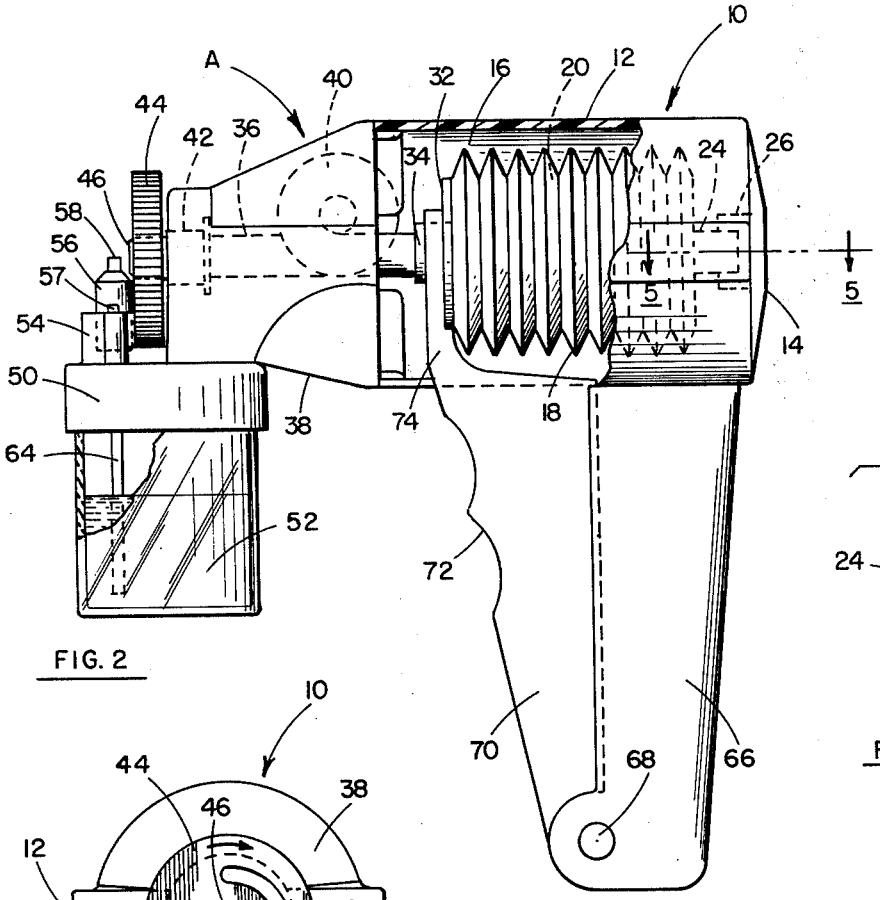
Figure 5A:
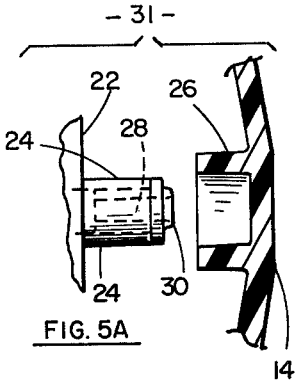
Figure 3:
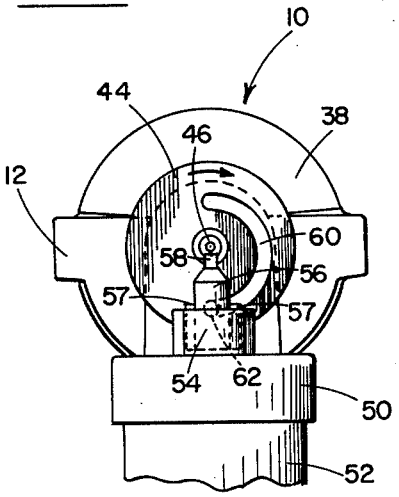
Figure 4:
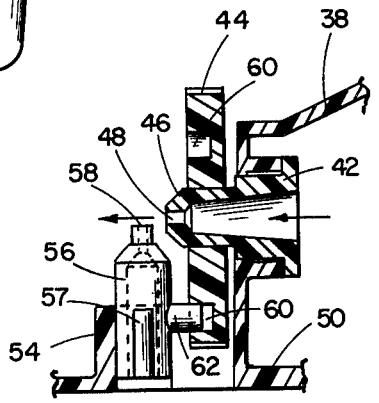

Having thus described the invention in general terms, reference will now be made to the accompanying drawings in which:

FIG. 1 is a top-plan view of a toy spray gun constructed in accordance with and embodying the present invention;

FIG. 2 is a side-elevational view of the paint spray gun of FIG. 1, partially broken away and in section;

FIG. 3 is a fragmentary front elevational view of a portion of the toy spray gun of FIG. 1, and showing a portion of the air ejector mechanism forming a part thereof;

FIG. 4 is a fragmentary vertical sectional view taken along line 4—4 of FIG. 1;

FIG. 5 is a fragmentary horizontal view taken along line 5—5 of FIG. 2;

FIG. 5a is an expanded fragmentary sectional view similar to FIG. 5 and showing the components forming a check valve in more detail;

FIG. 6 is a vertical sectional view showing the easel construction of the present invention;

FIG. 7 is an exploded perspective view showing a portion of the easel construction along with the relationship of a substrate and a stencil usable therewith; and FIG. 8 is a perspective view of a base member which may be utilized with the easel construction.

DETAILED DESCRIPTION

Referring now in more detail and by reference characters to the drawings which illustrate preferred embodiments of the present invention, A designates a hand-held toy spray gun which generally comprises an outer housing 10 having a somewhat cylindrically shaped enclosing side wall 12 and a back end wall 14 which forms an internal chamber 16.

The various components of the housing as heretofore described and as hereinafter described may be made of any of a number of moldable plastic materials such as polyethylene, polystyrene, polybutadiene, various vinylidene compounds and the like. However, in a preferred aspect of the invention, most of the components of the spray gun can be molded from high-impact polystyrene. The housing and the related components, as hereinafter described, can be made in any of a number of conventional molding operations which thereby lends to the production of a toy spray gun at a relatively low cost, but with high durability.

Located within the chamber 16 of the housing 10 is a compressible and expandible bellows 18 which may also be made from any of a number of known plastic materials. However, in this case, the bellows 18 is preferably formed of a fairly flexible and resilient plastic material such as any of a number of known vinyl acetate compositions such as EVA. The bellows 18 is located within the housing 10 so that its longitudinal axis is essentially parallel to the longitudinal axis of the housing 10. Moreover, the bellows is constructed so that it forms an internal air chamber 20.

Adhesively secured to, or otherwise affixed to, the right-hand end or rear end of the bellows 18 is a mounting plate 22 which has a rearwardly struck stem 24 which communicates with the interior air chamber 20 of the bellows 18. The stem 24 is retained within an inwardly struck circular cup 26 integrally formed on the inner face of the end wall 14. In addition, a somewhat tapered plug 28 is retained with the stem 24 and is provided with an annular lip 30 capable of abutting against the interior surface of the end wall 14. When the bellows is contracted, the lip 30 will engage the end wall 14 and thereby seal the interior of the bellows 18 with respect to the external atmosphere. When the bellows 18 is expanded, the lip 30 separates from the wall 14 and opens the interior chamber 20 of the bellows 18 to the external atmosphere in the chamber 16 of the housing 10, thereby enabling the bellows 18 to be filled with air. In this way, the stem 24, in combination with the plug 28 and the end wall 14, operates as a check valve which enables the bellows to be filled with air on expansion and closes the bellows to the external atmosphere upon contraction.

Similarly affixed to the left-hand end or front end of the bellows 18 is a mounting plate 32 which similarly carries an air exit stem 34, the latter communicating with the air chamber 20 of the bellows 18. Connected to the air exit stem 34 is an air delivery tube 36 which passes through a somewhat tapered ejector head 38 integral with or otherwise affixed to the forward end of the housing 10. The air delivery tube 36 also includes a coiled section 40, somewhat in the form of a serpentine coil, in the manner as illustrated in FIG. 2 of the drawings.

The air delivery tube 36 is connected at its forward end to a fitting 42 which is carried by the eductor head 38 and which extends through a knurled adjustment knob 44 for reasons which will presently more fully appear. Finally, the fitting 42 is provided with an air nozzle 46 which is also provided with an air ejector orifice 48, as best illustrated in FIG. 4 of the drawings.

Mounted on the lower end of a portion of the eductor head 38 is a cap 50 which may be provided with an internally threaded section (not shown) for threaded attachment of a cannister or similar type container 52, which may preferably adopt the form of a plastic bottle. The cannister 52 would similarly be provided with a threaded section at its upper end for threaded attachment of the cap 50, although any conventional means of attaching the cannister 52 to the cap 50 may be employed. In this same respect, it should be observed that the cap 50 could be integrally formed with the eductor head 38. The cannister 52 is designed to contain liquid paint which is preferably a water-based paint for purposes of children's toys, although this invention could be utilized with other forms of paint.

Integrally formed with the cap 50 on the upper wall thereof is an upwardly struck retaining boss 54 and a liquid nozzle 56 is retained by and vertically shiftable in the retaining boss 54. In addition, the nozzle includes a pair of spaced apart upwardly extending fins 57 which are received in slots provided in the boss 54 to guide the nozzle 56 in its vertical shifting movement. The nozzle 56 is provided with a liquid emission orifice 58 located within a plane either closely adjacent to or within the plane of the stream of educted air passing through the air orifice 48, as more fully illustrated in FIGS. 2, 3 and 4 of the drawings. In this case, the nozzle 56 is hollow and the liquid emission orifice 58 is in fluid communication with the liquid paint contained within the cannister. The nozzle 56 includes a tube or pipe 64 which extends downwardly into the cannister 52 and is located beneath the surface of the liquid paint contained within the cannister 52.

By further reference to FIGS. 3 and 4, it can be seen that the knurled wheel 44 actually constitutes an adjustment wheel and is provided with an ecentric camming slot 60 which is designed to receive a camming pin 62 which is secured to and extends radially outwardly from the nozzle 56. In accordance with the construction in FIG. 4, it can be observed that the nozzle 56 is vertically shiftable within the boss 54. Thus, as the knurled adjustment wheel 44 is rotated, the changing position of the camming slot 60 relative to a horizontal axis passing through the air orifice 48 will change and, hence, will shift the nozzle 56 upwardly or downwardly relative to the air ejector orifice 48. In this way, a paint spray can be regulated in a manner to be hereinafter described in more detail.

Also mounted on the housing 10 is a downwardly struck pistol-grip type handle 66 and pivotally mounted at the lower end of the handle 66, by means of a pivot pin 68, is a manually actuable trigger 70 which may be conventionally provided with finger-receiving slots 72. At its upper end, the trigger 70 is provided with an actuating flange 74 which engages the front plate 32 on the bellows 18. In this way, when the trigger 70 is squeezed so that the flange 74 is urged rearwardly and the bellows 18 will be compressed. Due to the normal resiliency of the material used in the construction of the bellows, the bellows 18 is easily compressible and contractible. However, the bellows 18 is sufficiently non-elastic so that it will tend to expand to its initial uncontracted position upon release of the trigger 70. If desired, a compression spring could be located between the trigger 70 and the handle 66 so as to bias the trigger 70 forwardly upon release. Moreover, and in the same respect, the actuating flange 74 could be secured to the plate 32 so as to pull the bellows to an expanded position if desired.

As indicated above, the toy spray gun of the present invention operates on the principle of an air ejector such that liquid paint contained within the cannister 52 will be sucked into an air stream passing through the air ejector orifice 48 and atomized and carried in the air stream to a substrate. The check valve is designed so that it will be normally closed upon contraction of the bellows 18 and will be opened upon expansion of the bellows 18. Thus, when the trigger 70 is squeezed, the actuating flange 74 will squeeze the bellows 18 and cause contraction thereof. Inasmuch as the lip 30 forming part of the check valve construction bears against the wall 14 in sealingwise engagement, the bellows is closed to the external atmosphere, and air contained within the air chamber 20 of the bellows 18 will be forced outwardly through the air delivery tube 36 under pressure. This air will thereupon pass through the air ejector orifice 48. As the air passes through the orifice 48, it will pass over the liquid emission orifice 58 which communicates with the liquid paint in the cannister 52.

An important feature of this ejector mechanism is the expansion of the air through the air nozzle and the discharge of which is in fluid communication with the liquid paint contained within the cannister 52. As the air under pressure issues from the air ejector orifice 48, its velocity head is increased with a corresponding decrease in its pressure head. Since the pressure head is less than that of the liquid contained within the cannister 52 at that point, the liquid paint will be sucked through the tube 64 and nozzle 56 and the liquid emission orifice 58. Moreover, upon introduction of the liquid paint into the air stream passing through the air orifice 48, the liquid paint will be atomized and carried in the air stream.

Upon release of the trigger 70, the bellows 18 will be permitted to expand to its normal uncontracted position, as illustrated in FIG. 2 of the drawings. However, as indicated above, upon expansion of the bellows 18, the check valve construction will open, thereby permitting air from the external atomosphere to enter the air chamber 20 of the bellows 18. In this way, the spray gun is now ready to be actuated for another discharge of liquid paint entrained in an air stream.

It can be observed in connection with the present invention that this simple ejector mechanism is highly effective for use in toy spray paint guns since the pressure head developed is relatively small, but, nevertheless, mechanically efficient. Moreover, this form of spray gun is highly effective in that it utilizes only relatively few moving parts and, in essence, the only real moving parts in the actual air ejector mechanism constitute the bellows 18, the trigger 70 and the components forming the check valve construction.

In connection with the bellows 18 of the present invention, while the bellows is the preferred means to produce a source of air under pressure by mechanical actuation, other devices could be used as well. Thus, a flexible chamber forming member, such as a diaphragm-type device, could be used, such that upon compression a source of air under pressure could be emitted. Inaddition, the present invention contemplates the use of a manually operable air-pump, such as a piston-cylinder arrangement. In this construction, the trigger could force a piston into the cylinder and force air in the cylinder through an aperture in the cylinder wall.

One of the unique aspects of the spray gun is that the housing 10, the pistol-grip type handle 66 and the trigger 70 are designed so that the spray gun can be held in one hand and completely operated from the same hand. Moreover, no external source of gas under pressure is required, since manual actuation of the trigger member will cause the chamber member to produce a source of air under pressure.

As indicated above, the position of the nozzle 56, and hence the liquid emission orifice 58, can be adjusted relative to the air stream passing through the air ejector orifice 48. By locating the liquid emission orifice 58 in close proximity to the air orifice 48, a greater amount of liquid paint will be sucked into the air stream. Moreover, by lowering the nozzle 56, and hence the liquid emission orifice 58, with respect to the air stream, a lesser amount of liquid paint will be sucked into and atomized in the air stream. The relative positioning of the nozzle 56, and hence the liquid emission orifice 58, can be simply adjusted by merely rotating the knurled wheel 44, as previously described.

The spray gun of the present invention is also designed to produce a somewhat speckled effect when the spray impinges on and dries on a substrate. The spray gun is not designed to create a dense spray to completely cover an area subjected to receiving a spray blast. Accordingly, the prior art spray devices could not effectively operate as a child's paint sprayer.

The easel construction which may be utilized in the present invention in conjunction with the hand-held spray gun A is more fully illustrated in FIGS. 6 and 7 of the drawings. In this case, the easel construction includes an easel E comprising an easel frame 80 having a front plate 82 and rectangularly shaped peripheral wall 83. The plate 82 is provided with a rectangularly shaped recess 84 which is sized to receive a substrate, designated as S, and which may be in the form of a paper substrate, along with a stencil, designated as M, and which is also hereinafter described in more detail. The recess 84 may be also provided with a pair of diagonally located cross ribs 86 in order to retain the substrate S and the stencil M.

A retaining frame 88 cooperates with the stencil frame 80 and includes a pair of offset and outwardly struck lugs 90 which are capable of being inserted through apertures 92 in the plate 82. Inasmuch as the lugs are offset relative to the plane of the retaining frame 88, the retaining frame 88 can essentially pivot somewhat through the lugs 90 being inserted in the apertures 92, such as to an open position, as illustrated in FIG. 6 of the drawings. Moreover, the retaining frame 88 is provided with a handle 94 on its upper end and with a rearwardly projected pin 96 which extends through an aperture 98 in the plate 82. In this case, the pin on the handle 94 would be provided for snug fitting, but nevertheless removable engagement with the aperture 98. The retaining frame 88 is also provided with a rearwardly struck, rectangularly shaped flange 100 which extends into the recess 84 and also serves to marginally register the substrate S with the stencil M. In this way, it can be observed that the retaining frame 88 can retentively, but nevertheless removably, hold the substrate S and the stencil M within the recess 84 of the stencil frame 80 and essentially in marginal alignment.

The substrate S as indicated above may preferably be a sheet of paper, although any form of substrate can be utilized in accordance with the present invention. Thus, for example, the substrate S may adopt the form of a canvas sheet or the like. The stencil M may also be formed of paper or otherwise any plastic sheet of material as desired. In any event, the stencil M includes a plate 102 having a plurality of openings 104 formed therein. In this way, the openings 104 form a pattern in which paint from the spray gun A may pass through the openings and onto the substrate S in conformance with the pattern of the openings 104. Again, the present invention may be provided with a plurality of stencils each having different forms of openings 104 in order to create different patterns.

The easel frame 80 may also be provided with a stand in the form of a support leg 106 having a pair of spaced apart retaining flanges 108 at its upper end, in the manner as illustrated in FIG. 6 of the drawings. In addition, the leg 106 may be provided with an outwardly struck foot 110 for support on a floor or similar supporting surface. The retaining flanges 108 would extend through an aperture formed in a mounting flange 112 located on the inner section of the cross ribs 86. In this way, the support leg 106 can be removed from the easel frame 80 as desired. The easel construction of the present invention including the easel frame 80 and the leg 106, as well as the retaining frame 88, can all be made of any of number of moldable plastic materials, such as those plastic materials mentioned above. Again, these components would preferably be made of a high-impact polystyrene material.

The present invention also provides a base B which may also be used in conjunction with the easel construction illustrated in FIGS. 6 and 7. In this case, the base B comprises a base plate 114 having a recessed slot 116 for receiving the lower end of the easel frame 80 and the support leg 106. In addition, the base B may also be provided with a rectangularly shaped upstanding wall 118 which forms a well 120, the latter being designed to retain the handle of the spray gun in an upright position when not in use, to avoid spilling liquid from the container 52.

Thus, there has been illustrated and described a unique and novel toy spray painting system which may be used by children and which meets all of the objects and advantages sought therefor. It should be understood that many changes, modifications, variations and other uses and applications will become apparent to those skilled in the art after considering this specification and the acompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by letters patent is:

1. A children's toy manually powered paint spraying system for spraying a paint composition onto a substrate, said spraying system comprising:

a. frame means, b. a container on said frame means for receiving a liquid paint composition therein, and said container having a generally upright tube which extends down into said container and defines a paint outlet at its upper end, c. means on said frame means defining a contractible and expandible air chamber capable of expelling air upon reduction in its size and capable of receiving air upon increase in its size, d. manually powered means on said frame means for causing reduction and increase in the size of said air chamber, e. means defining an air orifice in communication with said air chamber and capable of generating an exit stream of air under pressure upon reduction of said air chamber size, said paint outlet being located in proximity to said air orifice to cause emission of a portion of the paint composition in said container and to atomize said composition in a moving stream of air passing through said orifice to create a spray of the paint composition, f. adjustment means on said frame means for regulating the distance between said air orifice and said paint outlet and g. an easel construction for holding a substrate to receive the sprayed paint composition, said easel construction comprising:

a. an easel frame having a recess to receive a substrate, b. a stencil capable of being disposed in said recess over said substrate and having open portions to permit said paint composition to be received on said substrate and closed portions to block said paint composition, c. a retaining frame hingedly mounted on said easel frame to retain said substrate and said stencil in said recess, said retaining frame being shiftable from an open position to a closed position where said substrate and stencil are held in said recess, d. locking means for removably locking said retaining frame to said stencil frame, and e. a flange means extending from said retaining frame and into said recess to retain and hold said stencil and substrate.

2. The toy paint spraying system of claim 1 further characterized in that said paint composition is a water-based paint.

3. The toy paint spraying system of claim 1 further characterized in that the air passing through said orifice means causes an atomizing effect to create an air carrier spray of the paint composition in an initial liquid state for delivery to a substrate.

4. The system of claim 4 further characterized in that said flange means is a peripherally extending flange.

5. The spray gun of claim 1 further characterized in that a pistol-grip type handle extends from said frame means and a trigger member is pivotally mounted on said frame means and engages said bellows.

6. The system of claim 6 further characterized in that a leg is removably attachable for holding said easel frame in an upright position.

7. The system of claim 6 further characterized in that a base is provided for holding said easel frame.

8. The toy paint spraying sytem of claim 1 further characterized in that said chamber forming means comprises a bellows.

9. The spray gun of claim 4 further characterized in tha said bellows has an outlet operatively connected to said air orifice and an inlet connected to the external atmosphere.

10. The spray gun of claim 9 further charaterized in that a check valve is located in said inlet and opens upon expansion of said bellows and closes upon compression of said bellows.

11. The spray gun of claim 9 further characterized in that a tube having a serpentine type coil extends between said air orifice and said bellows outlet.

* * * * *

UNITED STATES PATENT OFFICE
CERTIFICATE OF CORRECTION

PATENT NO. : 4,023,524

DATED : May 17, 1977

INVENTOR(S) : Adolph E. Goldfarb, et al

It is certified that error appears in the above-identified patent and that said Letters Patent are hereby corrected as shown below:

In Claim 4, column 10, line 9, change "Claim 4" to -- Claim 1 --

In Claim 6, column 10, line 15, change "Claim 6" to --Claim 1 --

In Claim 9, column 10, line 23, change "Claim 4" to --Claim 8 --

In Claim 9, column 10, line 24, change "tha" to -- that --

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*